United States Patent [19]

McMath

[11] Patent Number: 4,649,969

[45] Date of Patent: Mar. 17, 1987

[54] LIQUID DISPENSING NOZZLE HAVING A SEALING ARRANGEMENT FOR VAPOR RETURN MEANS

[75] Inventor: Jack A. McMath, Fort Thomas, Ky.

[73] Assignee: Dover Corporation, New York, N.Y.

[21] Appl. No.: 800,980

[22] Filed: Nov. 22, 1985

Related U.S. Application Data

[63] Continuation of Ser. No. 683,657, Dec. 19, 1984, abandoned, which is a continuation of Ser. No. 918,057, Jun. 22, 1978, abandoned, which is a continuation of Ser. No. 856,110, Nov. 30, 1977, abandoned, which is a continuation of Ser. No. 696,937, Jun. 17, 1976, abandoned.

[51] Int. Cl.[4] ..... B65B 1/28

[52] U.S. Cl. ..... 141/290

[58] Field of Search ..... 141/1, 44, 45, 46, 52, 141/59, 93, 97, 128, 198, 206–229, 290, 301, 302, 311 R, 346, 347, 392, DIG. 1; 251/364

[56] References Cited

U.S. PATENT DOCUMENTS

| | | | |
|---|---|---|---|
| 2,350,905 | 6/1944 | Koehler | 251/364 X |
| 3,900,056 | 8/1975 | Giardini et al. | 141/290 X |
| 3,926,231 | 12/1975 | Madden et al. | 141/59 X |
| 3,982,571 | 9/1976 | Fenton et al. | 141/207 X |
| 3,996,979 | 12/1976 | Barr et al. | 141/302 |
| 4,013,930 | 6/1977 | Sutcliffe et al. | 141/226 X |

*Primary Examiner*—Stephen Marcus
*Assistant Examiner*—Mark Thronson
*Attorney, Agent, or Firm*—Kinney & Schenk

[57] ABSTRACT

A liquid dispensing nozzle has a check valve mounted adjacent the front of the nozzle body to seal an annular vapor return passage, which is between the spout and a bellows, to prevent communication through vapor return passages in the nozzle to the vapor recovery equipment unless the spout is disposed in the fill pipe of a vehicle tank. One of the elements of the check valve for forming this seal is mounted on the spout and the other is mounted on a member, which is slidably supported by the nozzle body.

6 Claims, 10 Drawing Figures

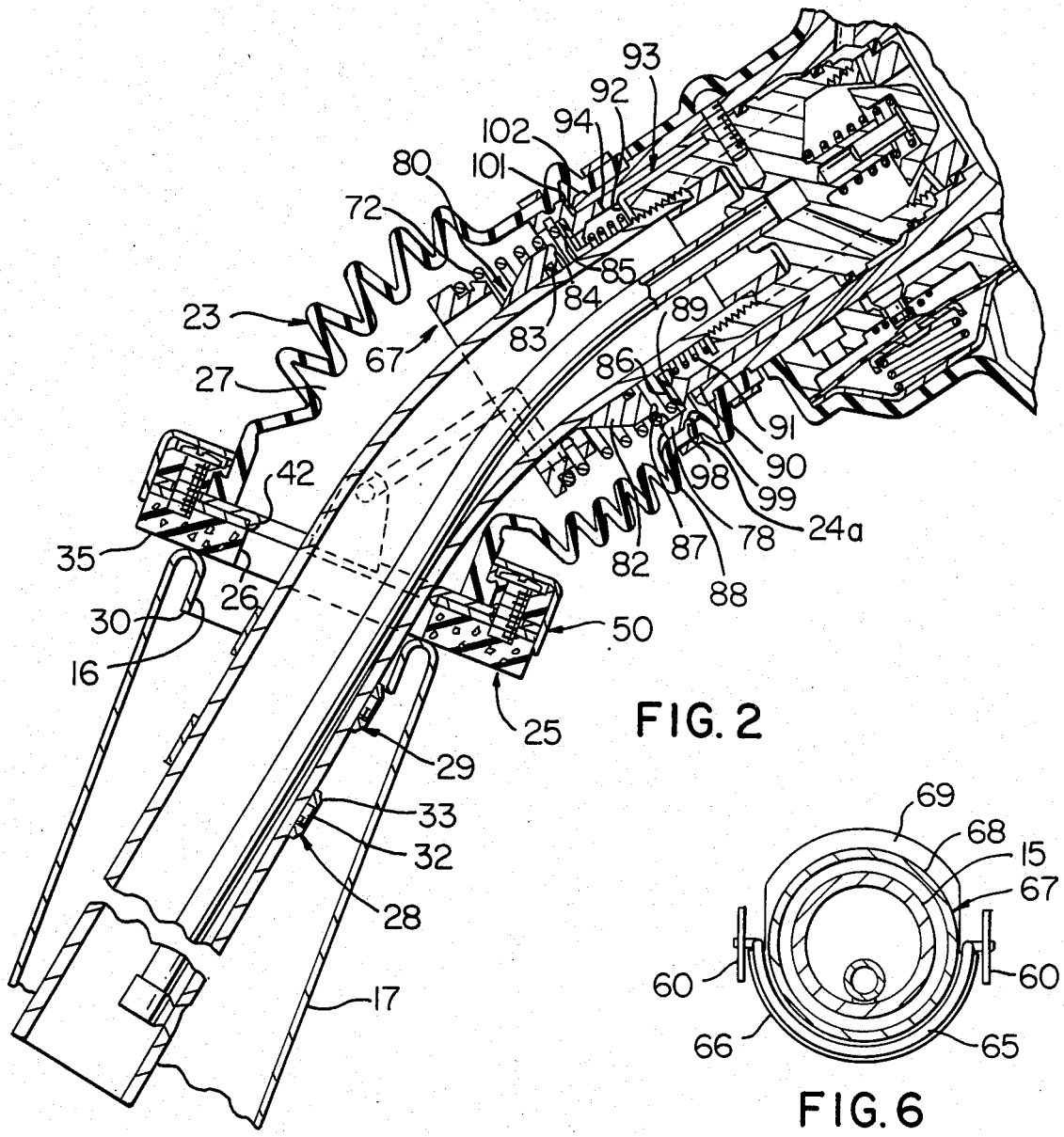
FIG. 2
FIG. 6
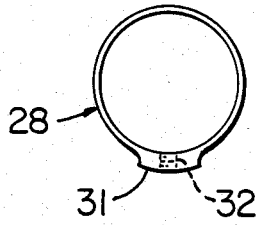
FIG. 8
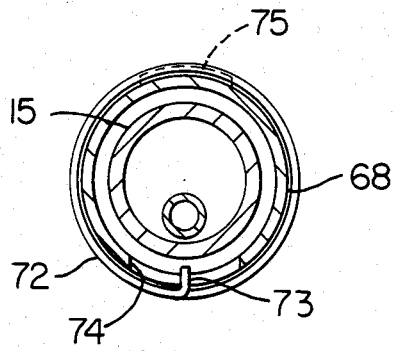
FIG. 7

LIQUID DISPENSING NOZZLE HAVING A SEALING ARRANGEMENT FOR VAPOR RETURN MEANS

This is a continuation of application Ser. No. 683,657 filed Dec. 19, 1984 now abandoned; which is a continuation of application Ser. No. 918,057 filed June 22, 1978, now abandoned; which is a continuation of application Ser. No. 856,110 filed Nov. 30, 1977, now abandoned; which is a continuation of application Ser. No. 696,937 filed June 17, 1976, now abandoned.

When filling a vehicle tank with gasoline through a dispensing nozzle, vapors from the gasoline within the tank are prevented from escaping through the fill pipe opening in which the spout of the nozzle is inserted by sealing the fill pipe opening. Thus, the escape of gasoline vapors to the atmosphere is prevented so that pollution of the atmosphere is decreased. The vapors within the tank can be recovered through vapor recovery equipment utilized in conjunction with the nozzle and connected thereto.

U.S. Pat. No. 3,866,636 to Lasater discloses a sealing arrangement between the fill pipe being filled and the vapor return or recovery passage of the nozzle. This sealing arrangement of the aforesaid Lasater patent also seals the vapor return or recovery passage when the tank is not being filled so that the vapor recovery equipment does not communicate with the atmosphere.

The present invention is an improvement of the aforesaid Lasater patent in that there can be certain conditions in which sealing of the vapor recovery passage is not maintained when the spout is not disposed in the fill pipe. This occurs when the sealing surface is disposed so that the sealing surface, which cooperates with a conical surface on a retainer or stop on the spout, is disposed at an angle other than perpendicular to the longitudinal axis of the spout. This occurs because the sealing means having the sealing surface is capable of movement relative to the spout. While this amount of leakage is small, it is desired to be able to seal the vapor return or recovery passage whenever the spout is not disposed in the fill pipe.

The present invention satisfactorily solves this problem through utilizing a check valve in the vapor return or recovery passage. The check valve functions as sealing means to normally seal the vapor return passage and to allow flow through the vapor return passage to the vapor recovery equipment only when the spout is disposed in the fill pipe with sufficient force so that the seal on the nozzle seals the fill pipe opening.

The sealing arrangement of the present invention also functions to reduce the force of the spring to move the sealing arrangement to its open position and the force of the spring to return the sealing arrangement to its closed position after it has been opened. Thus, this enables easier operation of the liquid dispensing nozzle because of the reduced spring forces required to be exerted by the user of the nozzle.

An object of this invention is to provide an improved sealing arrangement for a liquid dispensing nozzle having a vapor recovery system.

Other objects, uses, and advantages of this invention are apparent upon a reading of this description, which proceeds with reference to the drawings forming part thereof and wherein:

FIG. 2 is a fragmentary sectional view, partly in elevation, of the nozzle of FIG. 1 with the spout of the nozzle disposed in the fill pipe of a vehicle tank to be filled and the sealing arrangement in its open position.

FIG. 6 is a cross sectional view of the nozzle taken along line 6—6 of FIG. 1 and showing the connection of the spring retainer to the end of the bellows.

FIG. 7 is a cross sectional view of the nozzle of FIG. 1 taken along line 7—7 of FIG. 1 and showing the connection of one end of the spring to the spring retainer.

FIG. 8 is a plan view of one of the latch rings for retaining the spout of the nozzle within the fill pipe.

Figure 1:
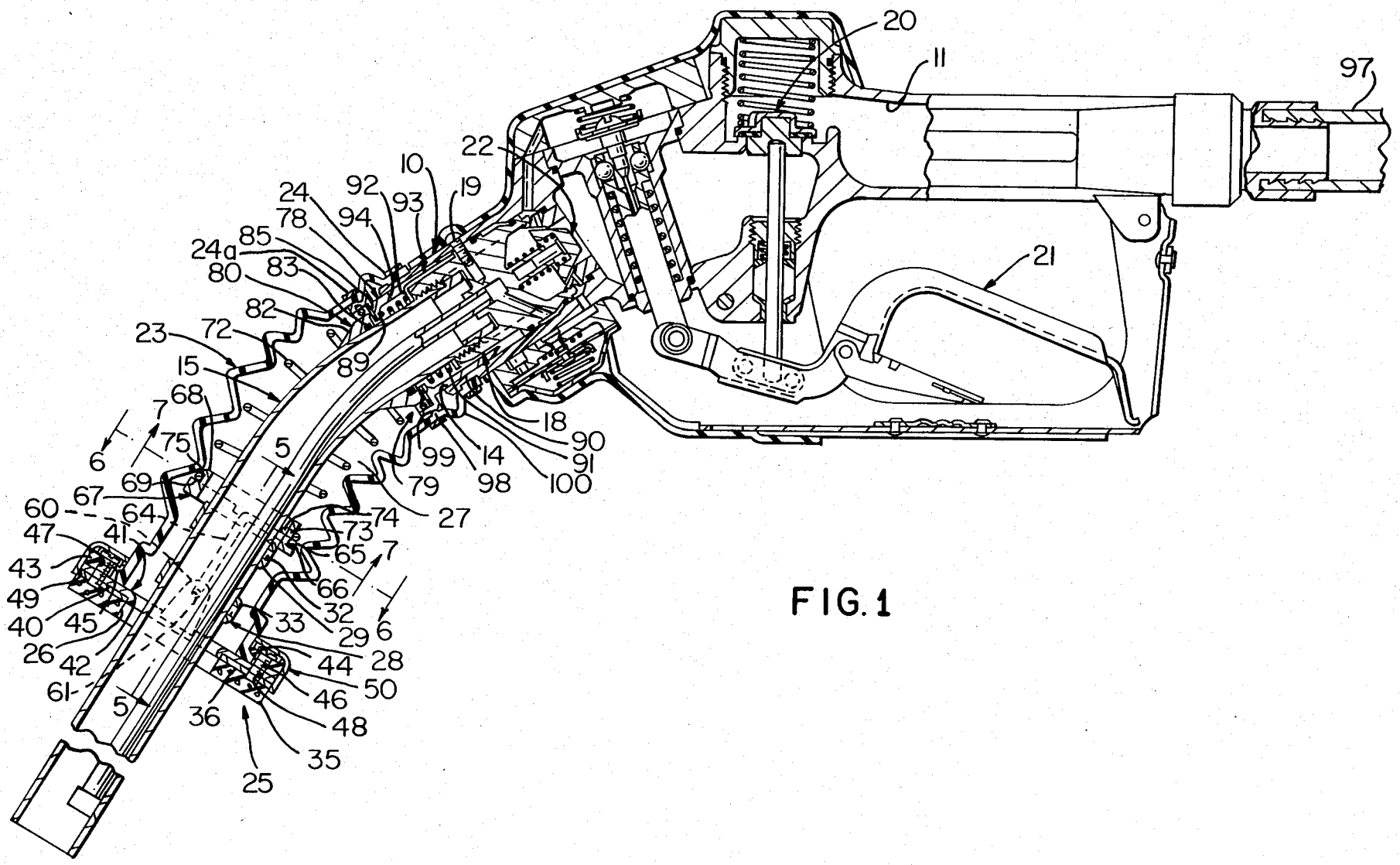
FIG. 1 is a sectional view, partly in elevation, of a liquid dispensing nozzle having one form of the sealing arrangement of the present invention with the sealing arrangement in its closed position.

Referring to the drawings and particularly FIG. 1, there is shown a liquid dispensing nozzle including a nozzle body 10. The nozzle body 10 has an inlet 11 to which a hose is connected to supply liquid such as gasoline, for example, to the interior of the body 10. The body 10 has an outlet 14 with which a spout 15 communicates to receive liquid from the interior of the body 10.

The spout 15, which is adapted to be inserted within an opening 16 (see FIG. 2) in a fill pipe 17 of a vehicle taank such as an automobile fuel tank, for example, has an end threaded in a spout adapter 18 (see FIG. 1), which is connected to the outlet 14 of the body 10 by a screw 19. The screw 19 is preferably formed of a material that will break or shear when subjected to a predetermined force. Thus, if the spout 15 should be retained in a vehicle tank when the vehicle is moved, the screw 19 breaks and allows the spout adapter 18 to be pulled from the body 10 without any damage to the body 10 or to the pump to which the body 10 is connected by the inlet hose.

The body 10 has a first or main poppet valve 20, which is controlled by a manually operated lever or handle 21, and a second poppet valve 22 therein. The valves 20 and 22 control the flow to the spout 15 in the manner more particularly shown and described in U.S. patent 3,823,752 to Lasater et al.

The outlet 14 of the body 10 has one end of a bellows 23, which is preferably formed of a gasoline resistant synthetic rubber, for example, secured thereto by being held thereon by a clamp 24. The other end of the bellows 23 has a relatively soft sealing means 25 removably fastened thereto. The relatively soft sealing means 25 has an enlarged opening 26 formed in the center thereof to enable the relatively soft sealing means 25 to slide along the spout 15.

When the spout 15 is inserted in the fill pipe opening 16 as shown in FIG. 2, the relatively soft sealing means 25 engages the end of the fill pipe 17 to form a seal therewith through being compressible. Thus, any vapor within the tank being filled can flow from the tank through the fill pipe opening 16 and the opening 26 in the relatively soft sealing means 25 into an annular passage 27, which is formed between the bellows 23 and the spout 15.

The spout 15 has two latch rings 28 and 29 formed thereon for engagement with a lip 30 of the fill pipe 17 to hold the free end of the spout 15 within the fill pipe 17. Thus, the spout 15 can be held in two different positions within the fill pipe 17.

Each of the latch rings 28 and 29, which are identical, is selectively positioned along the length of the spout 15. As shown in FIG. 8, the latch ring 28 has an eccentric retaining lug 31. It is necessary for the retaining lug 31 of each of the latch rings 28 and 29 to be positioned on the bottom of the spout 15. The retaining lug 31 has a threaded passage to receive a set screw 32 (see FIG. 1) to retain each of the latch rings 28 and 29 on the spout 15 in the desired spaced relation to each other.

As shown in FIG. 1, the retaining lug 31 of each of the latch rings 28 and 29 has an inclined surface or shoulder 33 formed at an angle to insure that the retaining lug 31 (see FIG. 8) will not slip off the lip 30 (see FIG. 2) of the fill pipe 17. The angle of the inclined surface or shoulder 33 must be selected so that the retaining lug 31 will not catch on the lip 30 of the fill pipe 17 to such an extent that it cannot be removed. The inclined surface of shoulder 33 preferably has an angle of 15° to the spout 15.

The retaining lug 31 of each of the latch rings 28 and 29 provides a minimum blockage to vapor flow through the fill pipe opening 16 as shown in FIG. 2 when the spout 15 is locked by the retaining lug 31 of the latch ring 29 engaging the lip 30 of the fill pipe 16. If the retaining lug 31 of the latch ring 28 engages the lip 30, there is the additional advantage of the retaining lug 31 of the latch ring 29, which is disposed within the bellows 23, also blocking the annular passage 27 to a minimum.

As shown in FIG. 1, the relatively soft sealing means 25 includes a member 35, which is formed of a suitable compressible material such as soft rubber or foam rubber, for example, and a steel plate 36, which is bonded to the member 35.

The thickness of the member 35 depends upon the material of which it is formed. The member 35 must have sufficient thickness so that it will be resilient enough to form a seal with the fill pipe 17 but not so thick as to be too soft and not form the seal with the fill pipe 17 (see FIG. 2).

The support plate 36 (see FIG. 1) abuts an annular base plate 40 of a retainer 41, which is formed of a rigid material. The retainer 41 can be formed of a suitable metal or plastic having the desired rigidity and is preferably formed of an acetal plastic such as Delrin, for example. The retainer 41 has a curved inner portion 42 overlapping the inner surface of the annular plate 36. The curved inner portion 42 is formed with a radius of curvature so that the retaining lug 31 of each of the latch rings 28 and 29 moves smoothly thereover during movement of the spout 15 with respect to the retainer 41 and the relatively soft sealing means 25.

A retaining ring 43, which is formed of a plastic, for example, is disposed adjacent the base plate 40 of the retainer 41 to retain an enlarged end 44 of the bellows 23 therebetween. The retaining ring 43 has a recess 45 formed therein to receive the enlarged end 44 of the bellows 23 with the enlarged end 44 being retained between the retaining ring 43 and the base plate 40 of the retainer 41.

Figure 4:
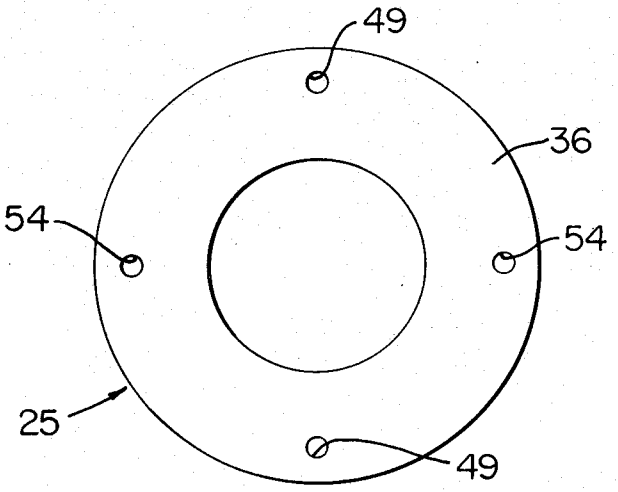
FIG. 4 is a plan view of the support plate of the present invention.

A pair of screws 46, which are diametrically disposed to each other, extends through holes 47 in the retaining ring 43 and into threaded holes 48 in the base plate 40 of the retainer 41 to secure the retainer 41 and the retaining ring 43 to each other. As shown in FIG. 4, the plate 36 has a pair of diametrically disposed holes 49, which are not threaded, to receive the ends of the screws 46 (see FIG. 1).

The securing of the retainer 41 and the retaining ring 43 to each other squeezes the enlarged end 44 of the bellows 23 between the retaining ring 43 and the annular base plate 40 of the retainer 41. The recess 45 in the retaining ring 43 has a groove for cooperation with a portion of the enlarged end 44 of the bellows 23 to prevent pulling out of the enlarged end 44 of the bellows 23 from the recess 45 after the bellows 23 has been squeezed between the retaining ring 43 and the annular base plate 40 of the retainer 41 by the screws 46 securing the retainer 41 and the retaining ring 43 to each other.

Figure 3:
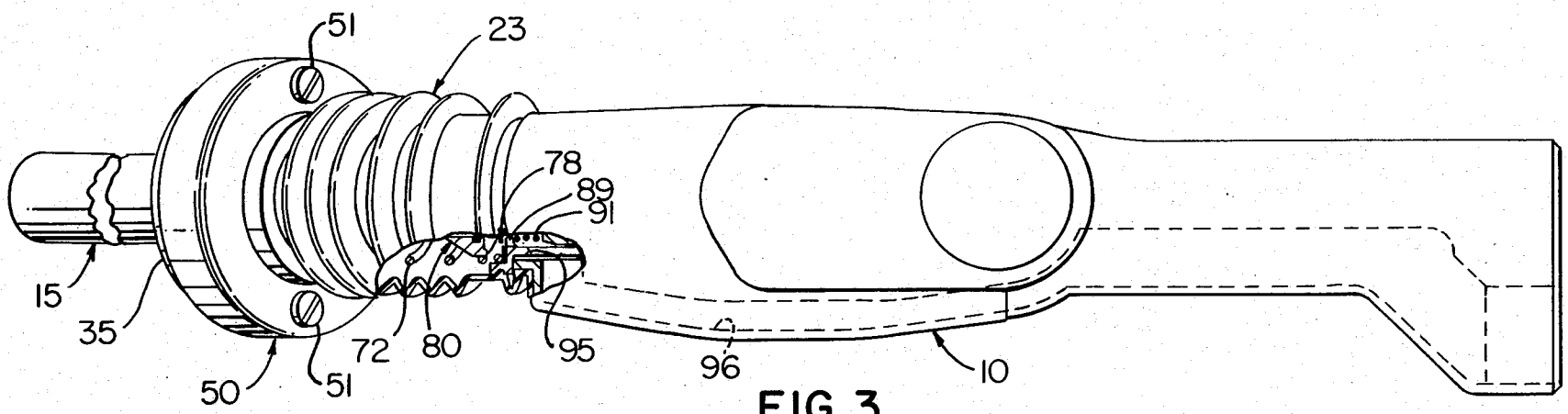
FIG. 3 is a fragmentary perspective view of a portion of the nozzle of FIG. 1.
Figure 5:
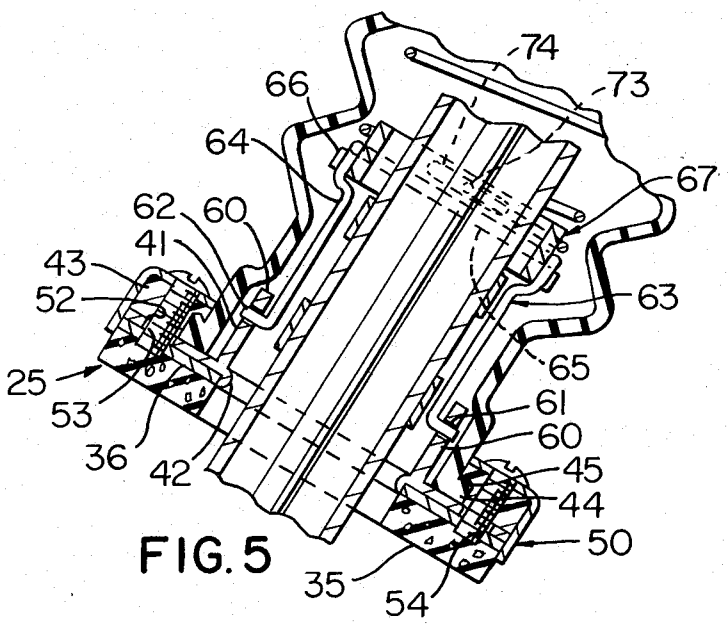
FIG. 5 is a fragmentary sectional view of the nozzle taken along line 5—5 of FIG. 1 and showing the connection of the relatively soft seal to the end of the bellows.

As shown in FIGS. 1 and 2, a cup-shaped cover 50 is disposed over the screws 46, the retaining ring 43, the outer surface of the base plate 40 of the retainer 41, the outer surface of the plate 36, and a portion of the outer surface of the member 35. The cover 50 has a pair of screws 51 (see FIGS. 3 and 5), which are diametrically disposed from each other and 90° from each of the screws 46, extending therethrough. The screws 51 also extend through non-threaded holes 52 in the retaining ring 43, non-threaded holes 53 in the base plate 40 of the retainer 41, and into threaded holes 54 (see FIGS. 4 and 5) in the annular plate 36 of the relatively soft sealing means 25.

Accordingly, the screws 51 not only retain the cover 50 in position but also enable the relatively soft sealing means 25 to be removably fastened to the end of the bellows 23. Thus, whenever the member 35 wears, the relatively soft sealing means 25 can easily be replaced through removing the two screws 51 and positioning another of the relatively soft sealing means 25 adjacent the base plate 40 of the retainer 41.

The opening 26 (see FIG. 2) in the relatively soft sealing means 25 provides communication to the annular passage 27 from the fill pipe 17 through an opening defined by the inner curved portion 42 of the retainer 41. Thus, as shown in FIG. 2, the member 35 engages the end of the fill pipe 17 to form a seal therebetween while providing communication to the annular passage 27 which functions as part of the vapor return passage to vapor recovery equipment (not shown).

The retainer 41 has a pair of diametrically disposed ears 60 (see FIGS. 1 and 5) extending upwardly from diametrically disposed portions of the annular base plate 40. Each of the ears 60 has an opening 61 formed therein to receive an end 62 of a wire connector 63. Each of the ends of the wire connector 63 has a leg 64 extending therefrom with the legs 64, which are substantially parallel to the spout 15 and on opposite sides thereof, connected by a semicircular portion 65 (see FIGS. 5 and 6).

The semicircular portion 65 of the wire connector 63 is supported on an arcuate flange 66, which extends for a slightly less distance than the semicircular portion 65 as shown in FIG. 6, of a spring retainer 67. The retainer 67 is a hollow cylindrical body 68 having the arcuate flange 66 extending from one side thereof and a second arcuate flange 69 extending from the opposite side thereof. As shown in FIG. 6, the arcuate flange 69 extends a smaller angular amount than the arcuate flange 66. As shown in FIGS. 1 and 2, the flange 66 is closer to the relatively soft sealing means 25 than the flange 69.

The arcuate flange 69 supports a portion of a spring 72, which has its tab end 73 disposed in a slot 74 (see FIGS. 5 and 7) in the cylindrical body 68. The bottom of the slot 74 and the support surface of the flange 69 are in the same plane. The cylindrical body 68 has a protrusion 75, which is diametrically disposed to the slot 74, extending therefrom to overlie a portion of the spring 72 to retain the overlying portion of the spring 72 between the protrusion 75 and the arcuate flange 69.

The spring 72 extends from the spring retainer 67 in surrounding relation to a portion of the spout 15. The spring 72 has its other tab end disposed in an opening (not shown) in a slidable cylindrical member 78 (see FIG. 1), which is slidably supported within the outlet 14 of the body 10.

As shown in FIG. 7, the slot 74 in the spring retainer 67 extends for a substantially greater distance than the size of the tab end 73 of the spring 72. Thus, there can be relative rotation between the spring retainer 67 (see FIG. 1) and the spout 15 since the cylindrical member 78 cannot rotate relative to the spout 15 and the other tab end of the spring 72 is fixed to the cylindrical member 78 while the slot 74 enables relative motion of the tab end 73 of the spring 72 with respect to the spring retainer 67. Accordingly, the spout 15 can rotate relative to the relatively soft sealing means 25 and the spring retainer 67, which has the relatively soft sealing means 25 pivotally connected thereto.

The slidable cylindrical member 78 is a portion of a check valve 79, which also includes a seat ring 80 on the spout 15. The check valve 79 is the invention claimed in this application, and the relatively soft sealing means 25 with the related structure is the invention of Jack Alan McMath et al and is more particularly shown and described in their copending application for "Liquid Dispensing Nozzle Having A Sealing Arrangement For Vapor Recovery", Ser. No. 696,636, filed June 17, 1976, now abandoned, and assigned to the same assignee as the assignee of this application.

Both the ring 80 and the slidable member 78 are concentric to the longitudinal axis of the portion of the spout 15 on which the ring 80 is mounted. The ring 80, which has its surface 82 inclined to provide more streamlined flow of the vapor within the annular passage 27, is secured to the spout 15 by suitable means such as a pair of set screws disposed 90° from each other, for example. The ring 80 has a groove in its inner surface to receive an O-ring 83 to form a seal with the outer surface of the spout 15 on which the ring 80 is mounted.

The ring 80 has an annular projection or shoulder 84 (see FIG. 2) formed thereon adjacent its perphery for cooperation with an annular resilient disc 85, which is preferably formed of rubber and is fixed to an end face 86 of the slidable member 78 and retained thereon by the spring 72. The annular projection 84 on the ring 80 engages the resilient disc 85 intermediate its ends as shown in FIG. 1 to form a seal therebetween.

The resilient disc 85 is retained in the slidable member 78 within a recess 87 (see FIG. 2), which is formed by an enlarged annular portion 88 of the slidable member 78. The portion 88 has the opening, which has the other tab end of the spring 72 disposed therein, formed therein. Thus, a portion of the spring 72 is disposed in the recess 87.

The inner surface of the annular resilient disc 85 terminates in alignment with the inner ends of three lugs 89, which are equally angularly spaced from each other, at the junction of the enlarged annular portion 88 and a hollow cylindrical portion 90 of the slidable member 78. The resilient disc 85 has its flat surface, which is engaged by the annular projection 84 on the ring 80, substantially perpendicular to the longitudinal axis of the portion of the spout 15 on which the ring 80 is mounted. Thus, when there is relative movement between the ring 80 and the slidable member 78, there is axial motion of the resilient disc 85 relative to the annular projection 84 on the ring 80 in the direction of the longitudinal axis of the portion of the spout 15 having the ring 80 mounted thereon.

A spring 91, which has one end acting against the lugs 89 on the slidable member 78 and its other end acting against a ring 92 of a guide 93, continuously urges the resilient disc 85 of the slidable member 78 against the annular projection 84 on the ring 80 to seal the annular passage 27 from communication with the vapor recovery equipment. The guide 93 is disposed in a longitudinal slot 94 in the slidable member 78 to prevent relative rotation of the slidable member 78 during its sliding motion relative to the body 10. As more particularly shown and described in my copending patent application for "Automatic Shut-Off Nozzle With Vapor Return Seal," Ser. No. 684,441, filed May 7, 1976, and assigned to the same assignee as the assignee of this application, the guide 93 has a forked end to fit over a portion of the spout adapter 18 so as to not rotate with respect thereto whereby relative rotation of the slidable member 78 with respect to the spout 15 is prevented.

In addition to having the longitudinal slot 94 formed in the hollow cylindrical portion 90 of the slidable member 78, the hollow cylindrical portion 90 has a longitudinal cut out portion 95 (see FIG. 3) formed therein with its centerline 90° from the centerline of the slot 94. The cut out portion 95, which extends for the length of the hollow cylindrical portion 90 of the slidable member 78, provides communication from the interior of the slidable member 78 to a vapor return passage 96 in the body 10. The vapor return passage 96 communicates through a hose 97 (see FIG. 1) with the vapor recovery equipment.

When the spout 15 has its free end inserted in the fill pipe opening 16 as shown in FIG. 2, the spring 72 is compressed. This causes the spring 91 to be overcome to move the slidable member 78 and the resilient disc 85 away from the annular projection 84 on the ring 80. This result in the annular passage 27 no longer being sealed by the resilient disc 85 engaging the annular projection 84 on the ring 80 so that vapor can flow from the vehicle tank, which is being filled, through its fill pipe 17, the opening 16 of the fill pipe 17, the opening 126 in the relatively soft sealing means 25, the annular passage 27, the cut out portion 95 (see FIG. 3) in the slidable member 78, and the vapor return passage 96 in the body 10 to the vapour return hose 97 (see FIG. 1).

Thus, the vapor recovery equipment, which is connected to the vapor return hose 97, communicates with the vehicle tank being filled to receive the vapor therefrom. However, it cannot communicate with the atmosphere because the resilient disc 85 (see FIG. 2) moves away from the annular projection 84 of the ring 80 only after the spring 72 has been compressed sufficiently through disposing the free end of the spout 15 within the fill pipe opening 16 and holding it therein by the retaining lug 31 on one of the latch rings 28 and 29.

Vapor cannot flow between the bellows 23 and the portion 88 of the slidable member 78 because a portion 98 of the bellows 23 is disposed in a groove 99 in the portion 88 of the slidable member 78 and clamped thereto by a clamp 24*a*. The free end of the bellows 23 is retained against the body 10 by the clamp 24 (see FIG. 1). As a result of clamping the bellows 23 by the clamp 24 and clamping the portion 98 to the slidable member 78 by the clamp 24*a*, a portion 100 of the bellows 23 flexes when the slidable member 78 is moved from the position of FIG. 1 to the position of FIG. 2 to enable vapor flow to occur from the annular passage 27 to the vapor return hose 97 (see FIG. 1).

The slidable member 78 functions as an interlock sleeve to allow liquid flow through the body 10 only if the relatively soft sealing means 25 is in sealing engagement with the end of the fill pipe 17 when the spout 15 is inserted in the fill pipe opening 16 to supply the liquid thereto as more particularly shown and described in my aforesaid application for "Automatic Shut-Off Nozzle With Vapor Return Seal." Thus, the slidable member 78 functions in the manner shown and described in my aforesaid application for "Automatic Shut-Off Nozzle With Vapor Return Seal" to control liquid flow through the spout 15 and has the resilient disc 85 thereon to control vapor flow from the annular passage 27 to the vapor return hose 97 so that the vapor recovery equipment, which is connected to the vapor return hose 97, cannot communicate with the atmosphere at any time.

Considering the operation of the present invention, the free end of the spout 15 is inserted into the fill pipe opening 16 (see FIG. 1). As the spout 15 is inserted into the fill pipe opening 16, the member 35 of the relatively soft sealing means 25 engages the end of the fill pipe 17 as shown in FIG. 2. As the spout 15 continues to be moved into the fill pipe opening 16, the bellows 23 and the spring 72 are compressed. This is because the bellows 23 is fixed to the body 10, which has the spout 15 connected thereto so that the body 10 is moving towards the fill pipe 17 while the end of the bellows 23 secured to the retainer 41 through the retaining ring 43 cannot move. Since the spring retainer 67 can only pivot about its connection through the wire connector 63 to the retainer 41, the spring retainer 67 also is prevented from moving with the spout 15 as the spout 15 moves into the fill pipe opening 16.

As the spout 15 is advanced into the fill pipe 17 after the spring 72 has been compressed to load the relatively soft sealing means 25, the spring 91 is overcome so that the resilient disc 85 on the slidable member 78 is moved away from the annular projection 84 on the ring 80, which is mounted on the spout 15. When this occurs, vapor flow can occur from the annular passage 27 to the vapor return hose 97 (see FIG. 1). Further insertion of the spout 15 into the fill pipe (see FIG. 2) is accommodated by additional compression of the spring 72. This is to accommodate fill pipes of various construction.

The total motion of the slidable member 78 relative to the ring 80 and the nozzle body 10 is limited by a face 101 of the slidable member 78 engaging front end 102 of the body 10. Thus, there is a maximum compression of the spring 91.

When flow through the spout 15 is stopped, either automatically or manually as discussed in my aforesaid application for "Automatic Shut-Off Nozzle With Vapor Return Seal," the spout 15 is removed from the fill pipe opening 16. During removal of the spout 15 from the fill pipe opening 16, the spring 72 starts to expand first.

When the spring 72 has expanded sufficiently so that the forces produced by the springs 72 and 91 are equal, the spring 91 begins to expand but at a different rate then that at which the spring 72 is still expanding. As a result, the springs 72 and 91 cooperate to cause the resilient disc 85 to be moved into engagement with the annular projection 84 on the ring 80 during the removal of the spout 15 from the fill pipe opening 16.

When the resilient disc 85 engages the annular projection 84 on the ring 80, the spring 72 has still not completed its expansion so that it is still exerting a force against the relatively soft sealing means 25 to cause the relatively soft sealing means 25 to be in sealing engagement with the fill pipe 17. Therefore, the check valve 79 (see FIG. 1) as closed before the relatively soft sealing means 25 ceases to have sealing engagement with the fill pipe 17 (see FIG. 2). This insures that communication between the annular passage 27 and the vapor return hose 97 (see FIG. 1) is blocked before the relatively soft sealing means 25 ceases to have sealing engagement with the fill pipe 17 (see FIG. 2).

While the present invention has shown and described the resilient disc 85 as being mounted on the slidable member 78, it should be understood that the ring 80 could have the resilient sealing disc 85 formed thereon. In this arrangement, the annular projection 84 would be removed from the ring 80 and an annular projection formed on the slidable member 78.

Figure 9:
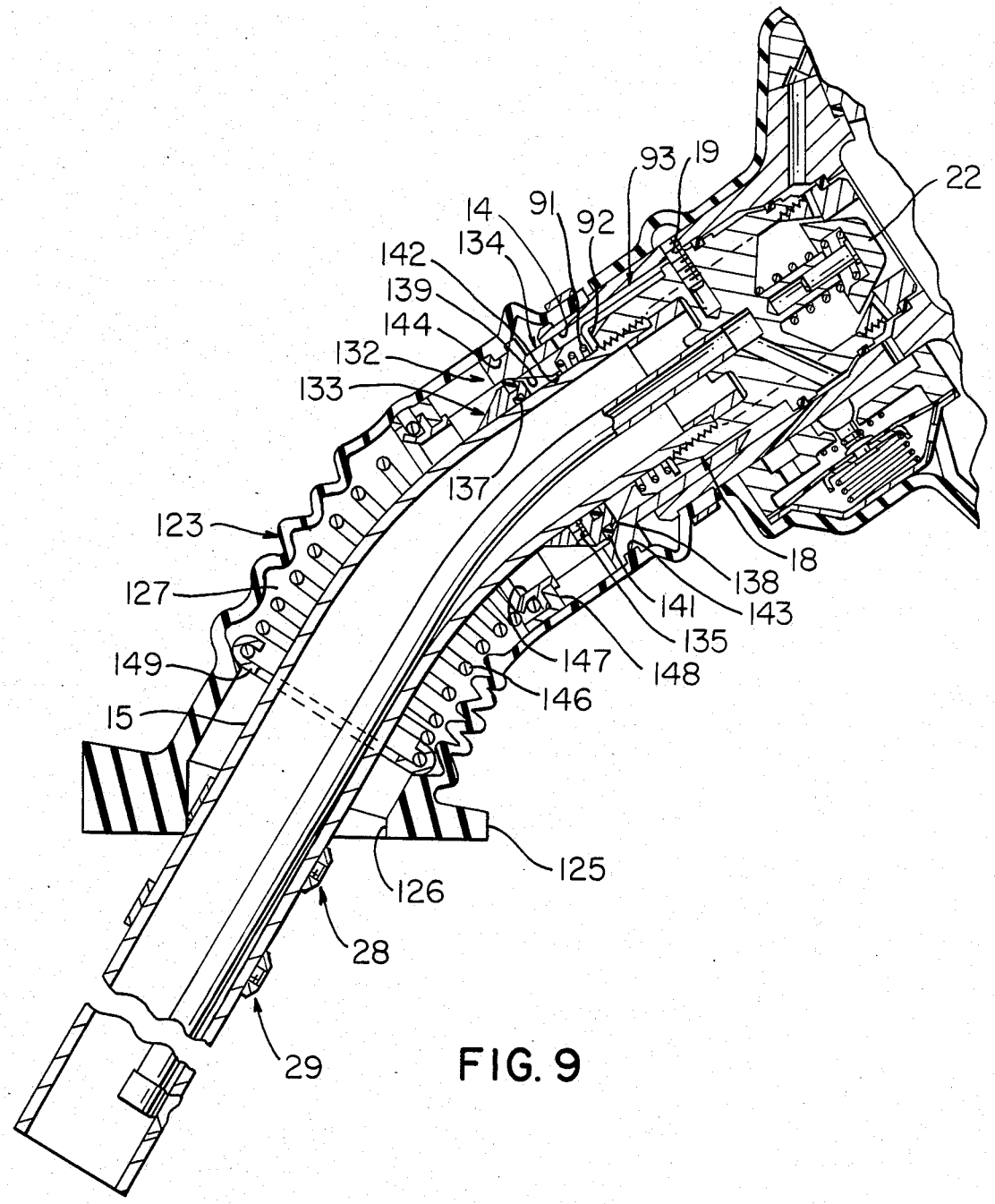
FIG. 9 is a fragmentary sectional view, partly in elevation, of another embodiment of the sealing arrangement of the present invention with the sealing arrangement in its closed position.
Figure 10:
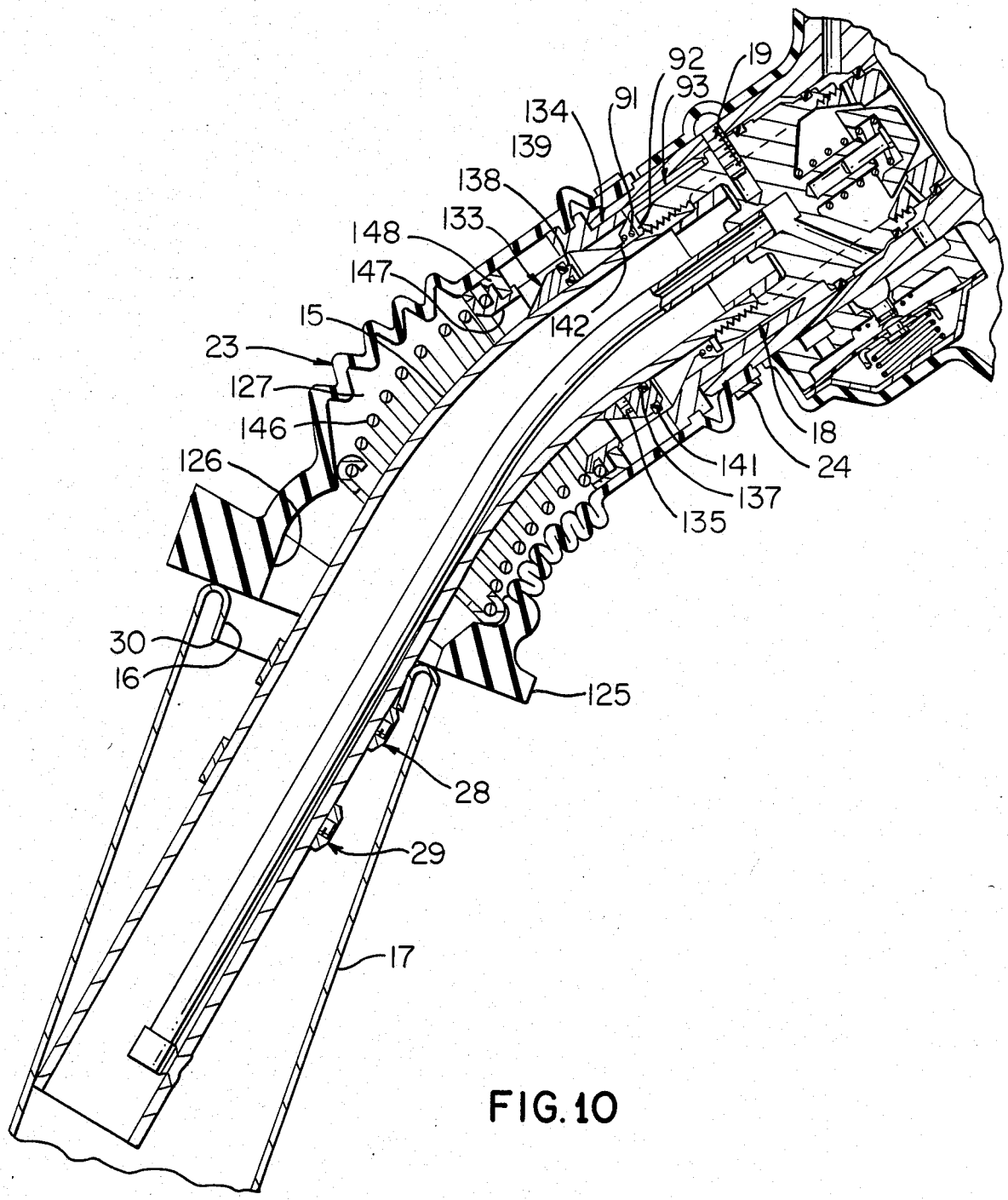
FIG. 10 is a fragmentary sectional view, partly in elevation, of the nozzle of FIG. 9 with the spout of the nozzle disposed in the fill pipe of a vehicle tank to be filled and sealing arrangement in its open position.

Referring to FIGS. 9 and 10, there is shown another form of the check valve of the present invention utilized with a different type of sealing arrangement at the fill pipe 17. In this embodiment, a bellows 123 replaces the bellows 23. While one end of the bellows 123 is secured to the body 10 by the clamp 24 in the same manner as the bellows 23, the other end of the bellows 123 has an enlarged member 125 integral therewith. The member 125 has an enlarged opening 126 formed in the center thereof to enable the member 125 to slide along the spout 15.

When the spout 15 is inserted in the fill pipe opening 16 as shown in FIG. 10, the member 125 engages the end of the fill pipe 17 to form a seal therewith so that any vapor within the tank being filled can flow from the tank through the fill pipe opening 16 and the opening 126 in the member 125 into an annular passage 127, which is formed between the bellows 123 and the spout 15.

The flow through the annular passage 127 to the vapor return hose 97 (see FIG. 1) is controlled by a check valve 132 (see FIG. 9), which permits flow only when the spout 15 is inserted within the fill pipe opening 16 (see FIG. 10) so that the enlarged member 125 of the bellows 123 seals at the end of the fill pipe 17. Thus, the check valve 132 (see FIG. 9) does not permit communication of the vapor recovery equipment, which is connected to the vapor return hose 97 (see FIG. 1), through the annular passage 127 (see FIGS. 9 and 10) to the atmosphere. The check valve 132 includes a ring 133 utilized in place of the ring 80 and a slidable cylindrical member 134 employed instead of the slidable member 78.

The slidable cylindrical member 134 is formed with a longitudinal cut out portion, which is the same as the longitudinal cut out portion 95 (see FIG. 3) of the slidable cylindrical member 78, to provide communication between the annular passage 127 (see FIGS. 9 and 10) and the passage 96 (see FIG. 3) in the body 10. This provides communication to the vapor return hose 97 (see FIG. 1) from the annular passage 127 (see FIGS. 9 and 10).

The ring 133 is secured to the spout 15 by suitable means such as a set screw 135, for example. The ring 133 has a groove in its inner surface to receive an O-ring 137 to form a seal with the outer surface of the spout 15 on which the ring 133 is mounted.

The ring 133 has a conical surface 138 formed thereon and generated from the same curve as a conical surface 139 on the slidable member 134. The conical surface 138 of the ring 133 has a groove therein to receive an O-ring 141.

The O-ring 141 engages the conical surface 139 of the slidable member 134 to prevent vapor flow between the vapor return hose 97 (see FIG. 1) and the annular passage 127 (see FIGS. 9 and 10). The spring 91 acts between the ring 92 of the guide 93 and guide legs 142 of the slidable member 134 to hold the conical surface 139 of the slidable member 134 in sealing engagement with the O-ring 141.

The slidable member 134 has a groove 143 to receive a portion 144 of the bellows 123 therein for retention by the clamp 24*a*. Thus, the bellows 123 has a portion between the groove 143 and the clamp 24 flex in the same manner as discussed with respect to FIGS. 1 and 2.

A spring 146 (see FIGS. 9 and 10) replaces the spring 72 of FIGS. 1 and 2. The upper end of the spring 146 is retained within a retainer 147. The retainer 147 moves against a member 148, which is secured to the bellows 123. The lower end of the spring 146 engages an annular retainer plate 149.

The operation of the embodiment of FIGS. 9 and 10 is the same as that for the apparatus of FIGS. 1 and 2 except that the O-ring 141 on the ring 133 engages the conical surface 139 of the slidable member 134 to prevent communication between the annular passage 127 and the vapor return hose 97 (see FIG. 1).

The O-ring 141 (see FIGS. 9 and 10) can be mounted in the conical surface 139 of the slidable member 134 through forming a groove in the conical surface 139. In this arrangement, the groove would be eliminated from the ring 133 so that the O-ring 141 could engage the conical surface 138 of the ring 133.

While the check valve 79 (see FIG. 1) has been shown as being utilized with the seal of the aforesaid McMath et al application for "Liquid Dispensing Nozzle Having A Sealing Arrangement For Vapor Recovery," it should be understood that the check valve 79 may be readily utilized with any type of seal for sealing the fill pipe opening to enable vapor recovery from the tank being filled. Thus, the check valve 79 of FIGS. 1 and 2 could be utilized with the seal of FIGS. 9 and 10, for example. Furthermore, the check valve 132 of FIGS. 9 and 10 could be utilized with the seal of FIGS. 1 and 2 or any other seal for sealing the fill pipe opening 16 to enable vapor recovery from the tank being filled.

An advantage of this invention is that less force is required to move the sealing member between its open and closed positions because of reduced friction forces due to the unique seal construction. Another advantage of this invention is that it provides a more reliable seal.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. A liquid dispensing nozzle comprising a body; a spout extending from said body having its free end for disposition in an opening of a fill pipe of a tank or the like; means to return vapor from the tank being filled to permanently remove the vapor from the tank to an area in which the vapor is collected for recovery, said vapor return means having no communication with said spout except through the tank being filled; first sealing means to form a seal between the fill pipe opening and said vapor return means when said spout is disposed in the fill pipe; second sealing means, separate from said first sealing means, to seal said vapor return means when said spout is not disposed in the fill pipe to prevent vapor from entering the atmosphere through said vapour return means from the area in which it is collected, said second sealing means being disposed within said vapor return means in spaced relation to said first sealing means; causing means to respond to said first sealing means being in its sealing position to cause said second sealing means to cease to be in its sealing position only after said first sealing means is in its sealing position; said second sealing means including first means and second means for cooperation with each other, said first means being mounted on said spout within said vapor return means, said second means being slidably supported by said body, said first and second means having sealing means to form a seal therebetween when said spout is not disposed in the fill pipe; said causing means including means to cause relative movement between said first and second means only after said first sealing means is in its sealing position when said spout is disposed in the fill pipe to cause said sealing means of said first and second means to cease to be in their sealing position; said vapor return means including compressible means in spaced relation to said spout to form an annular passage therebetween, said compressible means including a bellows having one end connected to said body, the other end of said bellows having said first sealing means connected thereto to enable vapor to flow through the annular passage; and said sealing means of said first and second means sealing the annular passage.

2. The nozzle according to claim 1 including means to form a seal between said bellows and said second means.

3. A liquid dispensing nozzle comprising a body; a spout extending from said body and having its free end for disposition in an opening of a fill pipe of a tank or the like; means to return vapor from the tank being filled to permanently remove the vapor from the tank to an area in which the vapor is collected for recovery, said vapor return means having no communication with said spout except through the tank being filled; first sealing means to form a seal between the fill pipe opening and said vapor return means when said spout is disposed in the fill pipe, said spout having relative movement with respect to said first sealing means when said spout is disposed in the fill pipe opening and said first sealing means engages the fill pipe; second sealing means, separate from said first sealing means, to seal said vapor return means when said spout is not disposed in the fill pipe to prevent vapor from entering the atmosphere through said vapor return means from the area in which it is collected, said second sealing means being disposed within said vapor return means in spaced relation to said first sealing means; first resilient means acting between said first sealing means and said second sealing means to urge said first sealing means into engagement with the fill pipe to form a seal between the fill pipe opening and said vapor return means when said spout is disposed in the fill pipe and to urge said second sealing means out of its sealing position; second resilient means acting between said second sealing means and said body to urge said second sealing means to its sealing position; and said second resilient means having a force greater than the force to said first resilient means when said first sealing means is not in sealing engagement with the fill pipe so that said second sealing means is moved to its open position against the force of said second resilient means by relative movement between said spout and said first sealing means only after said first resilient means has been compressed to enable said first sealing means to be in its sealing position and the force of said first resilient means to become greater than the force of said second resilient means.

4. The nozzle according to claim 3 in which said second sealing means includes first means and second means for cooperation with each other, said first means is mounted on said spout within said vapor return means, said second means is slidably supported by said body, said first and second means having sealing means to form a seal therebetween when said spout is not disposed in the fill pipe, said first resilient means acting on said second means of said second sealing means, and said second resilient means acting on said second means of said second sealing means to maintain said second means of second sealing means in engagement with said first means of said sealing means during relative movement of said spout with respect to said first sealing means until after said first resilient means has been compressed to maintain said first sealing means in its sealing position so that said second means of said second sealing means is moved rearwardly away from said first means of said second sealing means by the force of said first resilient means being greater than the force of said second resilient means.

5. A liquid dispensing nozzle comprising a body; a spout extending from said body and having its free end for disposition in an opening of a fill pipe of a tank or the like; means to return vapor from the tank being filled to permanently remove the vapor from the tank to an area in which the vapor is collected for recovery, said vapor return means having no communication with said spout except through the tank being filled; first sealing means to form a seal between the fill pipe opening and said vapor return means when said spout is disposed in the fill pipe; second sealing means, separate from said first sealing means, to seal said vapor return means when said spout is not disposed in the fill pipe to prevent vapor from entering the atmosphere through said vapor return means from the area in which it is collected, said second sealing means being disposed within said vapor return means in spaced relation to said first sealing means; and causing means to respond to said first sealing means being in its sealing position to cause said second sealing means to cease to be in its sealing position only after said first sealing means is in its sealing position, said causing means includes first means to continuously exert a force between said first sealing means and said second sealing means to urge said second sealing means out of its sealing position and second means to continuously exert a force between said second sealing means and said body to urge said second sealing means towards its sealing position, said second means of said causing means exerting a greater force than said first means of said causing means when said first sealing means is not in its sealing position to maintain said second sealing means in its sealing position, and said first means having its force increased when said first sealing means is in its sealing position so that the force of said second means is overcome to cause said second sealing means to cease to be in its sealing position.

6. A liquid dispensing nozzle comprising a body; a spout extending from said body and having its free end for disposition in an opening of a fill pipe of a tank or the like; means to return vapor from the tank being filled to permanently remove the vapor from the tank to an area in which the vapor is collected for recovery, said vapor return means having no communication with said spout except through the tank being filled; first sealing means to form a seal between the fill pipe opening and said vapor return means when said spout is disposed in the fill pipe; second sealing means, separate from said first sealing means, to seal said vapor return means when said spout is not disposed in the fill pipe to prevent vapor from entering the atmosphere through said vapor return means from the area in which it is collected, said second sealing means being disposed within said vapor return means in spaced relation to said first sealing means; and causing means to respond to said first sealing means being in its sealing position to cause said second sealing means to cease to be in its sealing position only after said first sealing means is in its sealing position, said second sealing means includes first means and second means for cooperation with each other, said first means is mounted on said spout within said vapor return means, said second means is slidably supported by said body, said first and second means having sealing means to form a seal therebetween when said spout is not disposed in the fill pipe, and said causing means include first means to continuously exert a force between said first sealing means and said second means of said second sealing means to urge said second means of said second sealing means away from said first means of said second sealing means so that said second sealing means is urged out of its sealing position and second means to continuously exert a force between said second means of said second sealing means and said body to urge said second means of said second sealing means against said first means of said second means so that said second sealing means is urged towards its sealing position, said second means of said causing means exerting a greater force than said first means of said causing means when said first sealing means is not in its sealing position to maintain said second means of said second sealing means in engagement with said first means of said second sealing means so that said second sealing means is maintained in its sealing position, and said first means of said causing means having its force increased when said first sealing means is in its sealing position so that the force of said second means of said causing means is overcome to move said second means of said second sealing means away from engagement with said first means of said second sealing means to cause said second sealing means to cease to be in its sealing position.

* * * * *